United States Patent [19]

Fukura et al.

[11] Patent Number: 4,583,713

[45] Date of Patent: Apr. 22, 1986

[54] PANTOGRAPH JACK APPARATUS

[75] Inventors: Kenichi Fukura, Toyota; Kazuhisa Nagata, Okazaki; Nobuhiro Yamauchi, Toyota, all of Japan

[73] Assignee: Aisin Seiki Kabushiki Kaisha, Japan

[21] Appl. No.: 749,673

[22] Filed: Jun. 28, 1985

[30] Foreign Application Priority Data

Jun. 29, 1984 [JP] Japan ..... 59-136088

[51] Int. Cl.[4] ..... B66F 3/08

[52] U.S. Cl. ..... 254/126

[58] Field of Search ..... 254/122, 126

[56] References Cited

U.S. PATENT DOCUMENTS 3,857,548 12/1974 Takeuchi ..... 254/126

4,092,012 5/1978 Ishigami ..... 254/126

*Primary Examiner*—Robert C. Watson

*Attorney, Agent, or Firm*—Finnegan, Henderson, Farabow, Garrett & Dunner

[57] ABSTRACT

A pantograph jack apparatus for elevating a motor vehicle includes first and second upper arms pivotally connected to a supporting plate engageable with the motor vehicle and first and second lower arms pivotally connected to a base plate supporting the jack apparatus at ground level. The first upper arm and first lower arm are pivotally connected to a threaded connecting nut that is threaded on the threaded portion of a shaft member. The second upper arm and second lower arm are pivotally connected to a connecting bearing rotatably mounted on the non-threaded portion of the shaft member. The connecting bearing is axially movable on the shaft member between two stop portions so that, when the connecting bearing abuts against the first stop portion, the jack is in its lowered position for storage and, when the connecting bearing abuts against the second stop portion, the jack is raised to a position where it is engageable with a jacking portion of the motor vehicle body. Thus, the jack can be raised to engage the motor vehicle body without rotating the shaft member. The pantograph jack apparatus also is provided with a mechanism for preventing the jack from being lowered by gravity after it has been raised to engage the motor vehicle body.

7 Claims, 7 Drawing Figures

PANTOGRAPH JACK APPARATUS

BACKGROUND OF THE INVENTION

1. Field of the Invention

The present invention relates to a pantograph jack apparatus for elevating the body of a motor vehicle, for example, to change a tire. In particular, the present invention relates to a pantograph jack apparatus that is easily set under a predetermined location on the motor vehicle body.

2. Description of Related Art

A conventional pantograph jack apparatus, such as that shown in Japanese Pat. No. 51-45860, is shown in FIGS. 1 and 2. Conventional pantograph jack 15 includes base plate 9 and supporting plate 8 connected by a pair of upper arms *7a, 7b* and a pair of lower arms *7c, 7d*. Supporting plate 8 includes specially shaped jacking portion *8a*, which engages with a complementary jacking portion located on the body of the motor vehicle. Upper arms *7a, 7b* are pivotally connected to supporting plate 8 by pins 10, and lower arms *7c, 7d* are pivotally connected to base plate 9 by pins 11. Upper arm *7a* is pivotally connected to lower arm *7c* by pin portions (not shown) of connecting nut 6. Upper arm *7b* is pivotally connected to lower arm *7d* by pin portions (not shown) of connecting bearing 5. Shaft member 1, which includes threaded portion *1a* and non-threaded portion *1b*, connects connecting nut 6 to connecting bearing 5.

As shown in FIG. 2, non-threaded portion *1b* of shaft member 1 includes first stop portion *3a* and second stop portion *3b*, which prevent connecting bearing 5 from moving relative to shaft member 1 in the axial direction. Connecting bearing 5, however, can rotate about non-threaded portion *1b* of shaft member 1 and is prevented from binding on the end of shaft member 1 by ball bearing 13. Operating member 4 is connected to the non-threaded end of shaft member 1.

Connecting nut 6 is threaded on threaded portion *1a* of shaft member 1 so that, as is well known in the art, when operating member 4 is rotated by a crank handle (not shown), shaft member 1 rotates, causing connecting nut 6 to move either toward or away from connecting bearing 5 through the cooperation of the threaded bore of connecting nut 6 with threaded portion *1a* of shaft member 1. When connecting nut 6 moves toward connecting bearing 5, supporting plate 8 is raised relative to base plate 9 by the well known pantograph action.

When not in use, conventional pantograph jacks, such as that shown in FIGS. 1 and 2, are normally stored in the motor vehicle in their lowered position, that is, with upper arms *7a, 7b* approximately parallel to lower arms *7c, 7d*, which is achieved by rotating operating member 4 and shaft member 1 to produce a maximum separation between connecting bearing 5 and connecting nut 6 and a minimum separation between supporting plate 8 and base plate 9.

When conventional pantograph jack 15 of FIGS. 1 and 2 is put in use to raise the motor vehicle body, base plate 9 first is positioned on the ground approximately beneath the jacking portion of the motor vehicle body, and supporting plate 8 then must be raised by rotating operating member 4 and shaft member 1 to engage jacking portion *8a* with the complementary jacking portion of the motor vehicle body.

Raising supporting plate 8 by rotating operating member 4 while simultaneously positioning jacking portion *8a* to properly engage the jacking portion of the motor vehicle body, however, has proved to be a cumbersome operation. The operator's attention must be divided between two portions of the pantograph jack, operating member 4 and supporting plate 8. Raising supporting plate 8 to the initial engaging position with the jacking portion of the motor vehicle by rotating operating member 4 also is a very time-consuming process because, to insure proper mating of jacking portion *8a* to the jacking portion of the motor vehicle body, operating member 4 must be turned by hand. If the operator chooses to save time by turning operating member 4 with its complementary crank, the operator will be too far removed from supporting plate 8 to see whether jacking portion *8a* is properly mating with the jacking portion of the motor vehicle body.

The present invention is intended to provide an improved pantograph jack that eliminates the problems of conventional pantograph jacks. In particular, the present invention is intended to provide an improved pantograph jack that enables the operator to raise the supporting plate and engage its jacking portion with the jacking portion of the motor vehicle body without rotating the operating member and shaft member of the pantograph jack.

Additional advantages of the present invention will be set forth in part in the description that follows and in part will be obvious from that description or can be learned by practice of the invention. The advantages of the invention can be realized and obtained by the apparatus particularly pointed out in the appended claims.

SUMMARY OF THE INVENTION

The present invention overcomes the problems of the prior art pantograph jacks by providing a pantograph jack apparatus having first and second stops on the non-threaded portion of the shaft member that permit movement of the connecting bearing relative to the non-threaded portion of the shaft member in the axial direction, thus enabling the supporting plate of the jack to be raised to engage the jacking portion of the motor vehicle without rotating the shaft member. The present invention also provides means for preventing the supporting plate from lowering itself by the force of gravity after it has been raised by preventing further movement of the connecting bearing along the non-threaded portion of the shaft member.

To overcome the problems of the prior art and in accordance with the purpose of the invention, as embodied and broadly described herein, the pantograph jack apparatus of this invention for elevating a motor vehicle body comprises: a base plate; a supporting plate; a shaft member having a threaded portion at one end and a non-threaded portion at the other end; a connecting nut cooperating with and threaded on the threaded portion of the shaft member; a connecting bearing rotatably mounted on and axially movable on the non-threaded portion of the shaft member; first and second upper arm members each having one end pivotally connected to the supporting plate, the other end of the first upper arm member being pivotally connected to the connecting nut and the other end of the second upper arm member being pivotally connected to the connecting bearing; first and second lower arm members each having one end pivotally connected to the base plate, the other end of the first lower arm member being pivotally connected to the connecting nut and the other end of the second lower arm member being pivotally connected to the connecting bearing; first and second stop portions fixedly connected to the non-threaded portion of the shaft member on axially opposite sides of the connecting bearing, the connecting bearing being axially movable between the stop portions, and the stop portions be separated by a predetermined distance so that the supporting plate is in a desired lowered position for storage when the connecting bearing abuts against the first stop bearing and the supporting plate is in a desired raised position for engaging the motor vehicle body when the connecting bearing abuts against the second stop portion; and means for preventing the connecting bearing from moving back toward the first stop portion after the connecting bearing is moved toward the second stop portion by raising the supporting plate.

Preferably, the means for preventing the connecting bearing from moving back toward the first stop portion comprises a coil spring interposed between the connecting bearing and the first stop portion and biasing the movement of the connecting bearing toward the second stop portion. Alternatively, the means for preventing the connecting bearing from moving back toward the first stop portion comprises a friction pad connected to the connecting bearing and frictionally engaging the non-threaded portion of the shaft member, or a threaded sleeve rotatably mounted on the non-threaded portion of the shaft member between the first and second stop portions and threadably engaging the connecting bearing.

The accompanying drawings, which are incorporated in and constitute a part of this specification, illustrate at least one embodiment of the invention and, together with the description, explain the principles of the invention.

DESCRIPTION OF THE PREFERRED EMBODIMENTS

Reference now will be made in detail to the presently preferred embodiments of the invention, examples of which are illustrated in the accompanying drawings.

Figure 1:
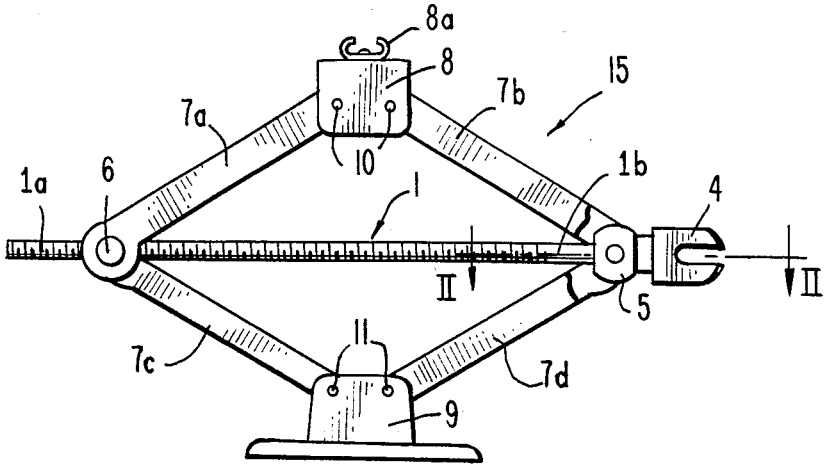
FIG. 1. (PRIOR ART)
FIG. 1 is a side elevational view of a prior art pantograph jack apparatus.
Figure 2:
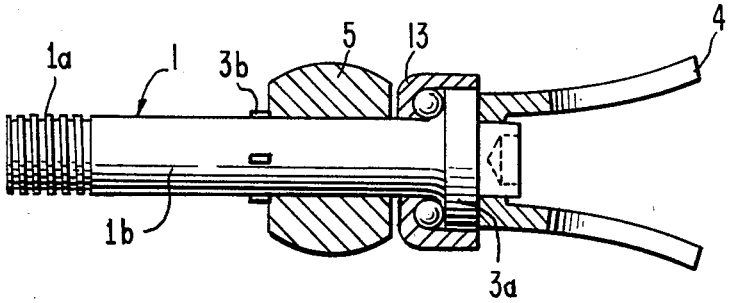
FIG. 2. (PRIOR ART)
FIG. 2 is a sectional view taken along lines II—II of FIG. 1.
Figure 3:
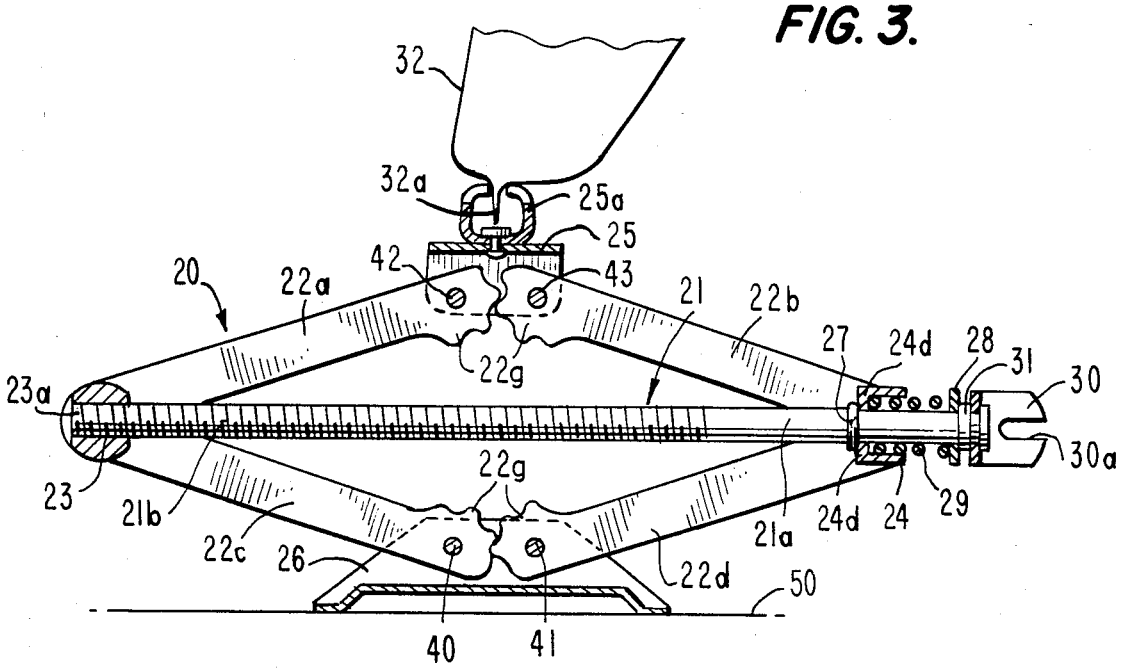
FIG. 3 is a side elevational view of the pantograph jack apparatus of the present invention in its raised position for engaging with a motor vehicle body.
Figure 5:
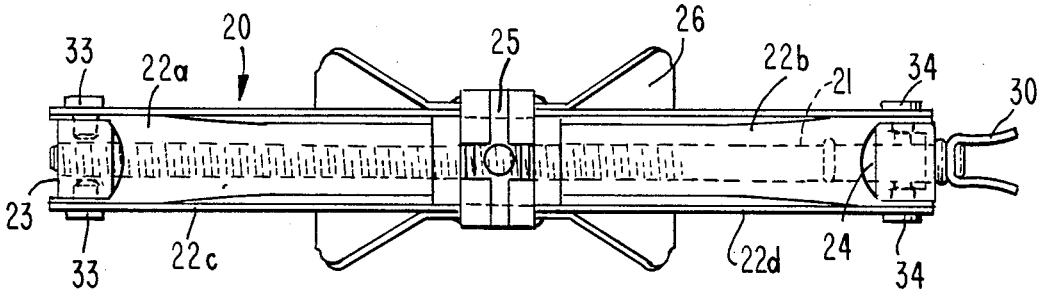
FIG. 5 is a top plan view of the lowered pantograph jack apparatus of FIG. 4.

FIG. 3 shows pantograph jack 20 of the present invention resting on surface 50 of the ground below motor vehicle body 32 and raised to a position to engage jacking portion 32*a* of motor vehicle body 32. Pantograph jack 20 includes first and second upper arms 22*a*, 22*b*, which are pivotally connected to supporting plate 25 by pins 42, 43. Supporting plate 25 includes channel-shaped jacking portion 25*a*, which is shaped to engage and cooperate with jacking portion 32*a* of motor vehicle 32 during the elevation of motor vehicle body 32 by jack 20. Pantograph jack 20 also includes first and second lower arms 22*c*, 22*d*, which are pivotally connected to base plate 26 by pins 40, 41. Base plate 26 rests on surface 50 of the ground or road surface beneath motor vehicle body 32. First upper arm 22*a* and first lower arm 22*c* are pivotally connected by pins 33 (see FIG. 5) to connecting nut 23, which includes threaded bore 23*a*. Second upper arm 22*b* and second lower arm 22*d* are pivotally connected to connecting bearing 24 by pins 34 (see FIG. 5). Preferably, arms 22*a*, 22*b*, 22*c*, 22*d* are of equal length and include complementary gear portions 22*g* at the ends connected to supporting plate 25 and base plate 26.

In accordance with the present invention, pantograph jack 20 further includes shaft member 21 having non-threaded portion 21*a* at one end and threaded portion 21*b* at the other end. Threaded bore 23*a* of connecting nut 23 is threaded onto threaded portion 21*b* of shaft member 21, and connecting bearing 24 is slidably and rotatably mounted on non-threaded portion 21*a* of shaft member 21. Shaft member 21 also includes first stop portion 31 and second stop portion 27, which are fixedly mounted on non-threaded portion 21*a* on opposite sides of connecting bearing 24. Operating member 30 is fixedly connected to the non-threaded end of shaft member 21 and includes slit portion 30*a* for engagement with a crank handle for rotating operating member 30 and shaft member 21.

Figure 4:
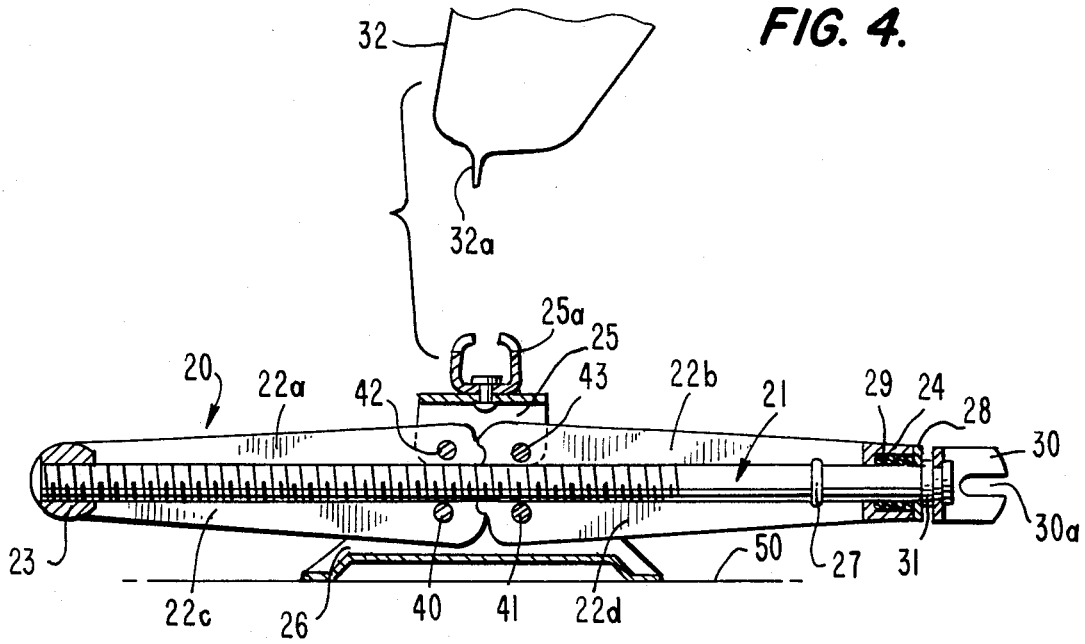
FIG. 4 is a side elevational view of the pantograph jack apparatus of FIG. 3 in the lowered position for storage.

As is well known in the art, moving connecting bearing 24 toward or away from connecting nut 23 causes supporting plate 25 to be raised or lowered, respectively, relative to base plate 26. Gear portions 22*g* cooperate with each other to prevent slippage and to ensure that the angle between upper arms 22*a*, 22*b* equals the angle between lower arms 22*c*, 22*d*. As shown in FIG. 4, the pantograph jack apparatus of the present invention is in its lowermost position, with upper arms 22*a*, 22*b* approximately parallel to lower arms 22*c*, 22*d*, when connecting bearing 24 is moved away from connecting nut 23 and abuts against first stop portion 31. Second stop portion 27 is spaced apart from first stop portion 31 by a predetermined distance such that, when connecting bearing 24 abuts against second stop portion 27, supporting plate 25 is raised above base plate 26 by a distance enabling jacking portion 25*a* of support plate 25 to engage jacking portion 32*a* of motor vehicle body 32, as shown in FIG. 3. In operating the pantograph jack apparatus of the present invention, therefore, the operator need not rotate operating member 30 to provide engagement between the pantograph jack and the motor vehicle body. The operator need only raise supporting plate 25 into engagement with motor vehicle body 32.

In accordance with the present invention, pantograph jack 20 also includes means for preventing connecting bearing 24 from sliding back toward first stop portion 31 after connecting bearing 24 is moved against second stop portion 27 by raising supporting plate 25. Preferably, the means for preventing connecting bearing 24 from sliding back toward first stop portion 31 includes bearing plate 28, which is located between connecting bearing 24 and first stop portion 31 and is rotatably mounted on shaft member 21, and coil spring 29, which is interposed between bearing plate 28 and bearing surface 24*d* of drum-shaped connecting bearing 24. When supporting plate 25 is raised to the position shown in FIG. 3, the biasing force of spring 29 keeps connecting bearing 24 abutted against second stop portion 27 and maintains supporting plate 25 in the raised position with jacking portion 25*a* engaged with jacking portion 32*a* of motor vehicle body 32.

After raising support plate 25 to engage the respective jacking portions 25*a*, 32*a*, the engagement being maintained by spring 29 acting between connecting bearing 24 and first stop portion 31, motor vehicle body 32 is elevated by rotating operating member 30 and advancing threaded portion 21*b* of shaft member 21 through threaded bore 23*a* of connecting nut 23. Initially, the rotation of operating member 30 and shaft member 21 serves only to compress spring 29 without elevating motor vehicle body 32. Once bearing plate 28 abuts against connecting bearing 24, however, further rotation of operating member 30 and shaft member 21 decreases the distance between connecting nut 23 and connecting bearing 24, thus raising supporting plate 25 and motor vehicle body 32 in the manner well known in the art. Bearing plate 28 prevents binding between first stop portion 31 and connecting bearing 24 during elevation of motor vehicle body 32.

After the operator is finished changing the tire or performing whatever motor vehicle maintenance operation that required elevation of motor vehicle body 32, operating member 30 is rotated in the direction opposite the direction used to elevate motor vehicle body 32, and motor vehicle body 32 and pantograph jack 20 are returned to the position shown in FIG. 3. To disengage jack portion 25*a* from jack portion 32*a*, the operator merely pushes down on supporting plate 25 against the biasing force of spring 29 to lower pantograph jack apparatus 20 to the position shown in FIG. 4. Pantograph jack apparatus 20 then can be stored, for example, in the trunk of the motor vehicle, in a manner well known in the art.

Figure 6:
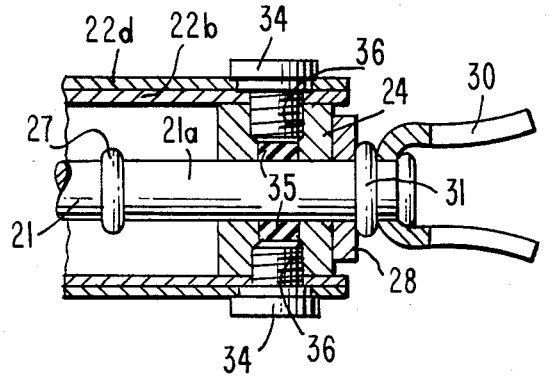
FIG. 6 is a partial sectional view of a second embodiment of the present invention.

An alternative embodiment of the means for preventing connecting bearing 24 from sliding back toward first stop portion 31 is shown in FIG. 6. In this second embodiment, connecting bearing 24 includes threaded holes 36, which intersect shaft member 21. Pins 34, which connect second upper arm 22*b* and second lower arm 22*d* to connecting bearing 24, are threaded in holes 36. Resilient pads 35 are inserted in the bottoms of holes 36 and are compressed against non-threaded portion 21*a* of shaft member 21 by pins 34 to frictionally engage shaft member 21. Bearing plate 28 is rotably mounted on shaft member 21 between first stop portion 31 and connecting bearing 24 to prevent binding while shaft member 21 is rotated to elevate the motor vehicle body.

The sliding friction between resilient pads 35 and shaft member 21 hold connecting bearing 24 in position against the force of gravity when supporting plate 25 is raised to engage with motor vehicle 32. The frictional force between resilient pads 35 and shaft member 21 is high enough to resist the gravitational loading transmitted through connecting bearing 24 but low enough that connecting bearing 24 is easily movable when raising and lowering supporting plate 25.

Figure 7:
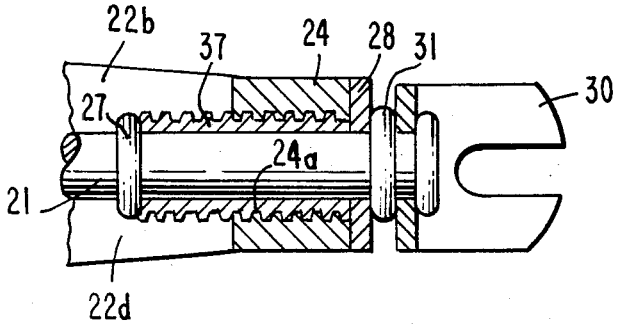
FIG. 7 is a partial sectional view of a third embodiment of the present invention.

A second alternative embodiment of the means for preventing connecting bearing 24 from sliding back toward first stop portion 31 is shown in FIG. 7. In this third embodiment, connecting bearing 24 includes threaded bore 24*a*, which engages with threaded sleeve 37. Threaded sleeve 37 is rotatably mounted on shaft member 21 between first stop portion 31 and second stop portion 27. The length of threaded sleeve 37 is approximately equal to the predetermined distance between stop portions 31, 27, so that threaded sleeve 37 is substantially restrained from moving in the axial direction relative to shaft member 21. Bearing plate 28 is rotatably mounted on shaft member 21. Bearing plate 28 is rotatably mounted on shaft member 21 between first stop portion 31 and connecting bearing 24.

The male threads of threaded sleeve 37 and the female threads of connecting bearing 24 have a large lead angle so that the mating threads produce relatively low friction forces. Thus, when the operator elevates supporting plate 25 to the position shown in FIG. 3, connecting bearing 24 moves from the position shown in FIG. 7 to a position abuting second stop portion 27. The lateral movement of connecting bearing 24 causes threaded sleeve 37 to rotate on shaft member 21 in cooperation with threaded portion 24*a* of connecting bearing 24. Although the frictional forces between the mating threads enable connecting bearing 24 to move in reaction to the raising of supporting plate 25, the mating threads provide sufficient frictional force to prevent connecting bearing 24 from returning to its position abutting first stop portion 31 through the gravitational force acting on pantograph jack 20.

It will be apparent to those skilled in the art that modifications and variations can be made in the pantograph jack apparatus of this invention. The invention in its broader aspects, therefore, is not limited to the specific details and illustrated examples shown and described. Accordingly, departure can be made from such details without departing from the spirit of applicants' general inventive concept.

What is claimed is:

1. A pantograph jack apparatus for elevating a motor vehicle body, comprising:

a. a base plate;

b. a supporting plate;

c. a shaft member having a threaded portion at one end and a non-threaded portion at the other end;

d. a connecting nut cooperating with and threaded on said threaded portion of said shaft member;

e. a connecting bearing rotatably mounted on and axially movable on said non-threaded portion of said shaft member;

f. first and second upper arm members each having one end pivotally connected to said supporting plate, the other end of said first upper arm member being pivotally connected to said connecting nut and the other end of said second upper arm member being pivotally connected to said connecting bearing;

g. first and second lower arm members each having one end pivotally connected to said base plate, the other end of said first lower arm member being pivotally connected to said connecting nut and the other end of said second lower arm member being pivotally connected to said connecting bearing;

h. first and second stop portions fixedly connected to said non-threaded portion of said shaft member on axially opposite sides of said connecting bearing, said connecting bearing being axially movable between said stop portions, and said stop portions being separated by a predetermined distance so that said supporting plate is in a desired lowered position for storage when said connecting portion abuts against said first stop portion and said supporting plate is in a desired raised position for engaging said motor vehicle body when said connecting bearing abuts against said second stop portion; and i. means for preventing said connecting bearing from moving back toward said first stop portion after said connecting bearing is moved toward said second stop portion by raising said supporting plate.

2. The apparatus of claim 1, wherein said means for preventing said connecting bearing from moving back toward said first stop portion includes spring means disposed between said first stop portion and said connecting bearing, said spring means biasing said connecting bearing away from said first stop portion.

3. The apparatus of claim 2, wherein said connecting bearing includes a recessed bearing surface, and said spring means includes a coil spring interposed between said recessed bearing surface of said connecting bearing and said first stop portion.

4. The apparatus of claim 3, further comprising a bearing plate rotatably mounted on said non-threaded portion of said shaft member between said first stop portion and said connecting bearing, said coil spring being interposed between said recessed bearing surface and said bearing plate.

5. The apparatus of claim 1, wherein said means for preventing said connecting bearing from moving back toward said first stop portion includes at least one resilient pad connected to said connecting bearing and frictionally engaging said non-threaded portion of said shaft member.

6. The apparatus of claim 5, wherein said connecting bearing includes at least one threaded pin member threadably connected to said connecting bearing, said resilient pad being positioned between said threaded pin member and said non-threaded portion of said shaft member.

7. The apparatus of claim 1, wherein said connecting bearing includes a threaded bore, and said means for preventing said connecting bearing from moving back toward said first stop portion includes a threaded sleeve rotatably mounted on said shaft member between said first and second stop portions and threadably engaging said threaded bore of said connecting bearing, said threaded sleeve having a length substantially equal to said predetermined distance between said first and second stop portions.

* * * * *